US007565101B2

(12) United States Patent
Yamanaka et al.

(10) Patent No.: US 7,565,101 B2
(45) Date of Patent: Jul. 21, 2009

(54) FIXING DEVICE AND IMAGE FORMING APPARATUS HAVING THE SAME

(75) Inventors: Takashi Yamanaka, Yamatokoriyama (JP); Kimihide Tsukamoto, Osaka (JP); Tatsuya Shinkawa, Nara (JP); Kan Mukai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 439 days.

(21) Appl. No.: 11/420,352

(22) Filed: May 25, 2006

(65) Prior Publication Data

US 2006/0269332 A1 Nov. 30, 2006

(30) Foreign Application Priority Data

May 30, 2005 (JP) ..... 2005-157774

(51) Int. Cl.
*G03G 15/20* (2006.01)

(52) U.S. Cl. ..... 399/323; 399/327

(58) Field of Classification Search ..... 399/322, 399/323, 327, 398

See application file for complete search history.

(56) References Cited

U.S. PATENT DOCUMENTS 4,168,902 A 9/1979 Golz
5,053,830 A * 10/1991 Arai ..... 399/323
5,802,434 A * 9/1998 Takehara et al. ..... 399/323
5,978,640 A * 11/1999 Segawa ..... 399/327
6,305,636 B1 * 10/2001 Satoh et al. ..... 399/327 X
6,650,862 B2 * 11/2003 Nakano et al. ..... 399/323

FOREIGN PATENT DOCUMENTS

| | | |
|---|---|---|
| JP | 64-040870 | 2/1989 |
| JP | 01-288888 | 11/1989 |
| JP | 5-257406 | 10/1993 |
| JP | 8-95390 | 4/1996 |
| JP | 10-149049 | 6/1998 |
| JP | 2001-100585 | 4/2001 |
| JP | 2003-084613 | 3/2003 |
| JP | 2003-107952 | 4/2003 |
| JP | 2003-156967 | 5/2003 |
| JP | 2003-280438 | 10/2003 |

* cited by examiner

*Primary Examiner*—Sandra L Brase
(74) *Attorney, Agent, or Firm*—Renner, Otto, Boisselle & Sklar, LLP

(57) ABSTRACT

A fixing device mounted in an electrophotographic image forming apparatus, for fixing a toner image formed on recording paper includes: a plurality of peeling claws provided for peeling off the recording paper from a fixing roller; a number-of-processed-sheet detecting portion for detecting a number of processed sheets of recording paper which is treated with a fixing process upon passing through the fixing roller; a peeling claw driving section for moving a plurality of the peeling claws in parallel with an axial direction of the fixing roller; and a control unit for controlling the peeling claw driving section to operate so that a relative position between the peeling claw and the fixing roller changes according to a detected output of the number-of-processed-sheet detecting portion.

6 Claims, 8 Drawing Sheets

NUMBER-OF-PROCESSED-SHEET DETECTING SECTION
7
CONTROL UNIT
9
DRIVING SOURCE
31
33
34
8
35
35a
37b
32
40
38
5
5a
W
20
WEB SHEET DRIVING SECTION
37
L1
41
39
43
44
37a

FIG. 5

| TYPES OF SHEET | PRINT RATIO | ROTATION CYCLE OF WIND-UP ROLLER (ONE TIME/NUMBR OF PRINTING SHEETS) | CONVERSION RATE TO A4 WIDTHWISE |
|---|---|---|---|
| A3 | 5% OR LESS | 10 SHEETS | × 2.00 |
| | 5 TO 8% | 7 SHEETS | |
| | 8 TO 12% | 5 SHEETS | |
| | 12% OR MORE | 3 SHEETS | |
| B4 | 5% OR LESS | 10 SHEETS | × 2.00 |
| | 5 TO 8% | 7 SHEETS | |
| | 8 TO 12% | 5 SHEETS | |
| | 12% OR MORE | 3 SHEETS | |
| A4 LENGTHWISE CONVEYANCE | 5% OR LESS | 15 SHEETS | × 1.33 |
| | 5 TO 8% | 10 SHEETS | |
| | 8 TO 12% | 7 SHEETS | |
| | 12% OR MORE | 5 SHEETS | |
| A4 WIDTHWISE CONVEYANCE | 5% OR LESS | 20 SHEETS | × 1.00 |
| | 5 TO 8% | 15 SHEETS | |
| | 8 TO 12% | 10 SHEETS | |
| | 12% OR MORE | 6 SHEETS | |
| B5/SMALL SIZE SHEET SUCH AS POSTCARD | 5% OR LESS | 30 SHEETS | × 0.67 |
| | 5 TO 8% | 20 SHEETS | |
| | 8 TO 12% | 15 SHEETS | |
| | 12% OR MORE | 10 SHEETS | |

FIG. 6

| TYPES OF SHEET | PRINT RATIO | ROTATION CYCLE OF WIND-UP ROLLER (ONE TIME/NUMBR OF PRINTING SHEETS) | CONVERSION RATE TO A4 WIDTHWISE AND PRINT RATIO OF 5% OR LESS |
|---|---|---|---|
| A4 WIDTHWISE CONVEYANCE | 5% OR LESS | 20 SHEETS | × 1.00 |
| | 5 TO 8% | 15 SHEETS | × 1.33 |
| | 8 TO 12% | 10 SHEETS | × 2.00 |
| | 12% OR MORE | 6 SHEETS | × 3.33 |

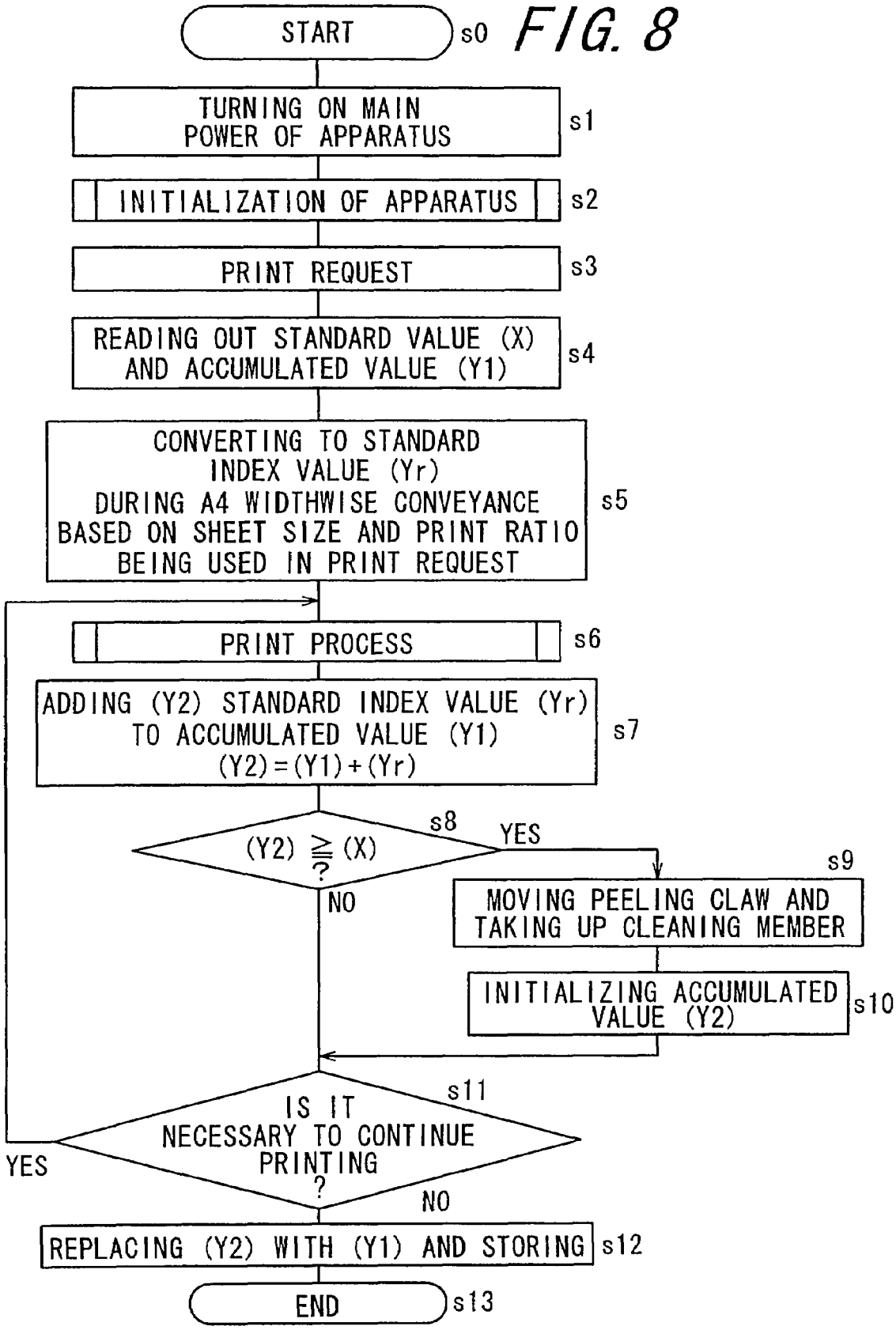
FIG. 8
START
s0
TURNING ON MAIN POWER OF APPARATUS
s1
INITIALIZATION OF APPARATUS
s2
PRINT REQUEST
s3
READING OUT STANDARD VALUE (X) AND ACCUMULATED VALUE (Y1)
s4
CONVERTING TO STANDARD INDEX VALUE (Yr) DURING A4 WIDTHWISE CONVEYANCE BASED ON SHEET SIZE AND PRINT RATIO BEING USED IN PRINT REQUEST
s5
PRINT PROCESS
s6
ADDING (Y2) STANDARD INDEX VALUE (Yr) TO ACCUMULATED VALUE (Y1) (Y2)=(Y1)+(Yr)
s7
(Y2) ≧ (X) ?
s8
YES
NO
MOVING PEELING CLAW AND TAKING UP CLEANING MEMBER
s9
INITIALIZING ACCUMULATED VALUE (Y2)
s10
IS IT NECESSARY TO CONTINUE PRINTING ?
s11
YES
NO
REPLACING (Y2) WITH (Y1) AND STORING
s12
END
s13

FIXING DEVICE AND IMAGE FORMING APPARATUS HAVING THE SAME

BACKGROUND OF THE INVENTION

1. Field of the Invention

The present invention relates to a fixing device, and to an image forming apparatus having the fixing device.

2. Description of the Related Art

In an image formation using an electrophotographic system, a photoreceptor charged to a uniform electric potential is exposed to light in accordance with image information so that an electrostatic latent image is formed. The formed electrostatic latent image is developed by a developer so as to be visualized. The visualized image is transferred onto recording paper or the like, and the transferred developer on the recording paper is made to be fixed thereon so as to form a solid recording image.

One of significant development objectives is to increase an output speed in a set of steps in the image formation, that is, to increase the number of recording paper sheets which can be subjected to the image formation steps, for one minute. In an image forming apparatus of conventional design, of which output speed is 30 to 40 sheets/min., a process speed is 200 to 400 mm/sec. In development of recent years is provided an image forming apparatus of which output speed is 100 sheets/min. or more (conversion to A4 widthwise conveyance). With realization of such an enhancement of the output speed, an image forming apparatus of which process speed reaches 450 mm/sec. or more and furthermore, 600 mm/sec. has appeared.

For increase in the output speed, that is, increase in the process speed of image information in the image forming apparatus, a print (image forming) process can be adapted by increasing a charging potential, increasing an applying voltage to a developing device, enlarging a developer container, or other changes.

However, in the fixing device of the invention, a heat quantity which can be given to fuse unfixed toner on recording paper, in other words, a fixing temperature which rises by heating a fixing roller is the same as that in the conventional fixing device, regardless of increase in the process speed. This is because setting the fixing temperature to a too high degree leads such a harmful effect that the toner is excessively fused at all times and hot offset is constantly generated.

Accordingly, even when a set fixing temperature of the fixing roller is the same as that in the conventional fixing device, with an increase in the process speed, a speed of the recording paper passing a nip region formed by a heating roller and a pressure roller which constitute the fixing roller becomes extremely high, thereby generating a phenomenon that heat transfer of the heating roller runs short. Moreover, when the recording paper is passing through the nip region, the recording paper draws heat from the fixing roller, with the result that the heat is more frequently removed per unit time by the recording paper.

When the heat is removed from the fixing roller by the recording paper, a control unit conducts a control of increasing an inputting electricity to the heating roller so that the fixing roller recovers the set fixing temperature. With a higher frequency of the decrease in temperature due to heat removal and the increase in the inputting electricity owing to the control, a ripple (variation of temperature in practice around the set fixing temperature) becomes larger so that a frequency of overshooting the set fixing temperature becomes high and moreover, a range of overshot temperature becomes wide.

Such an increase in the process speed makes the fixing temperature more easily overshoot the set value, and when overshooting the set value, the toner is excessively fused. The excessive fusion of the toner leads decrease in mold-releasing property of a to-be-conveyed recording paper from the heating roller, and contamination of the heating roller.

In the meantime, the fixing device is provided with a peeling claw for peeling off the recording paper from the fixing roller. Assuming that the toner is excessively fused as described above, when the peeling claw peels off the recording paper from the fixing roller, the excessively fused toner on the recording paper may be adhered to the peeling claw, resulting in contaminating the peeling claw. Further, the toner accumulated on the peeling claw through continuation of a fixing operation may cause jam which indicates that recording paper being conveyed is clogged, contaminating the fixing roller, contaminating images lead by the contamination of the fixing roller, and moreover surface damage of the fixing roller.

In a related art, a cleaning method for the peeling claw in order to cope with such problems has been proposed (for example, refer to Japanese Unexamined Patent Publication JP-A 10-149049 (1998)). In this cleaning method, while the fixing operation is not going on, the heating roller is heated so that the toner adhered to the peeling claw is softened or fused, and by rotating the heating roller in an opposite direction to a direction thereof under the fixing operation, the softened or fused toner is made to transfer from the peeling claw to the heating roller.

However, in the method disclosed by JP-A 10-149049, even when a cleaning operation is carried out, a total amount of softened or fused toner is not always transferred from the peeling claw to the heating roller. In a case where the toner remains on the peeling claw, a large amount of the toner will be accumulated on the peeling claw on a relatively early stage after restart of the fixing operation followed by the cleaning operation, resulting in a need for repetitively executing cleaning operations. Accordingly, there arises a problem that a running efficiency of image formation is made to decrease.

SUMMARY OF THE INVENTION

An object of the invention is to provide a fixing device capable of preventing a fixing roller from being contaminated or damaged due to toner accumulated on a peeling claw provided to the fixing device, for peeling off recording paper from the fixing roller.

The invention provides a fixing device mounted in an electrophotographic image forming apparatus, the fixing device comprising:

fixing rollers having a heating roller and a pressure roller;

a plurality of peeling claws for peeling off recording medium from the fixing roller;

a fixing roller cleaning section for cleaning the fixing roller by removing developer adhered to the fixing roller;

a number-of-processed-sheet detecting portion for detecting a number of processed recording mediums treated with a fixing process upon passing through the fixing roller;

a peeling claw driving section for moving a plurality of the peeling claws in parallel with an axial direction of the fixing roller; and a control unit for controlling the peeling claw driving section to operate so that a relative position between the peeling claw and the fixing roller changes according to a detected output of the number-of-processed-sheet detecting portion.

According to the invention, the fixing device comprises a plurality of the peeling claws provided for peeling off the recording medium from the fixing roller, the number-of-processed-sheet detecting portion for detecting the processed recording mediums treated with the fixing process upon passing through the fixing roller, the peeling claw driving section for moving a plurality of the peeling claw in parallel with the axial direction of the fixing roller, and the control unit. The control unit controls the peeling claw driving section to operate so that the relative position between the peeling claw and the fixing roller changes according to the detected output of the number-of-processed-sheet detecting portion. The relative position between the peeling claw and the fixing roller is made to change every time after treatments onto a predetermined number of processed sheets are completed, that is, every time after image-formed sheets are obtained, with the result that it is possible to prevent the peeling claw from causing contamination or damage on a specifically limited position of the fixing roller even when the toner is accumulated on the peeling claw.

Further, in the invention, it is preferable that a travel distance of the peeling claws moved in parallel with the axial direction of the fixing roller by the peeling claw driving section is equal to or longer than a width of peeling claw, which width indicates a dimension of the peeling claw in a direction parallel to the axial direction of the fixing roller.

Further, according to the invention, the peeling claw is made to move in the direction parallel to the axial direction of the fixing roller over the distance which is equal to or longer than the width of peeling claw, so that risk of contamination or damage of the fixing roller caused by the toner adhered to the peeling claw can be sufficiently diversified away in the axial direction of the fixing roller.

Further, in the invention, it is preferable that the plurality of the peeling claws for peeling off the recording medium from either roller of the heating roller or the pressure roller are mounted on one shaft, and by driving the one shaft at the peeling claw driving section, the plurality of the peeling claws mounted on one shaft move in parallel with the axial direction of the fixing roller.

According to the invention, a plurality of the peeling claws provided for peeling off the recording medium from the heating roller are mounted on one shaft and moreover, a plurality of the peeling claws provided for peeling off the recording medium from the pressure roller are mounted on another one shaft. One shaft on which the plurality of the peeling claws for peeling off the recording paper from respective rollers constituting the fixing roller are mounted, is driven at the peeling claw driving section. By so doing, a plurality of the peeling claws move in parallel with the axial direction of the respective rollers. This makes it possible, with a simple constitution, to readily move a plurality of the peeling claws in the axial direction of the respective rollers.

Further, in the invention, it is preferable that the one shaft is made to reciprocate in parallel with the axial direction of the fixing roller by the peeling claw driving section.

Further, according to the invention, the one shaft to which the plurality of the peeling claws for peeling off the recording paper from the respective rollers constituting the fixing roller are attached, reciprocates in parallel with the axial direction of the fixing roller by the peeling claw driving section. By thus making the shaft reciprocate, the risk of contamination or damage to the fixing roller caused by the toner adhered to the peeling claw can be sufficiently diversified away in the axial direction of the fixing roller without extending the travel distance of the peeling claw in parallel with the axial direction of the fixing roller, with the result that the apparatus can be reduced in size.

Further, in the invention, it is preferable that the shaft for holding the plurality of the peeling claws, and a driving shaft of the peeling claw driving section are separately formed, and an elastic member is provided so that the shaft for holding the plurality of the peeling claws is biased against the driving shaft of the peeling claw driving section, and the shaft for holding the plurality of the peeling claws moves in parallel with the axial direction of the fixing roller with a contact position with the driving shaft changing as the driving shaft rotates.

Further, according to the invention, the shaft for holding the plurality of the peeling claws and the driving shaft of the peeling claw driving section are separately formed, and the elastic member is provided so that the shaft is biased against the driving shaft of the peeling claw driving section, and the shaft moves in parallel with the axial direction of the fixing roller with a contact position changing as the driving shaft rotates. By so doing, it is made possible for a plurality of the peeling claws with a simple constitution to reciprocate in parallel with the axial direction of the fixing roller.

Further, in the invention, it is preferable that the fixing roller cleaning section comprises:

a cleaning member that is belt-shaped, wound up and provided so as to contact either one of the fixing rollers, for cleaning a surface of the fixing roller; a press-contact roller for pressing the cleaning member against the fixing roller with which the cleaning member comes into contact; a feed-out roller for feeding the cleaning member; a wind-up roller for taking up the cleaning member which has been fed from the feed-out roller and then cleaned the surface of the fixing roller; and a driving source for taking up the cleaning member, the driving source provided in the fixing roller cleaning section is used also as a driving source for the peeling claw driving section.

Further, according to the invention, the fixing device comprises the fixing roller cleaning section, and the driving source provided in the fixing roller cleaning section is used also as the driving source for the peeling claw driving section. This makes it possible to reduce the number of to-be-equipped driving sources, with the result that a cost for the apparatus can be reduced and moreover, an assembly operation of the apparatus can be simplified.

Further, the invention provides an image forming apparatus for forming a print image by use of electrophotographic system, comprising the fixing device mentioned above.

Further, according to the invention, the above-described fixing device is provided and therefore, it is possible to realize an image forming apparatus which forms images of excellent quality and of which durability lasts long without contamination to the recording paper or surface damage on the fixing roller caused by the toner being accumulated on the peeling claw, even when the image forming operation continues for a long period of time.

BRIEF DESCRIPTION OF THE DRAWINGS

Other and further objects, features, and advantages of the invention will be more explicit from the following detailed description taken with reference to the drawings wherein:

FIG. 5 is a view illustrating a table data for converting size and print ratio of recording paper to a standard index value;

FIG. 6 is a view illustrating a table data for converting size and print ratio of recording paper to a standard index value;

FIG. 8 is a flow chart for explaining a transfer operation of a peeling claw and a wind-up operation of a cleaning member through the control unit.

DETAILED DESCRIPTION OF THE PREFERRED EMBODIMENTS

Figure 1:
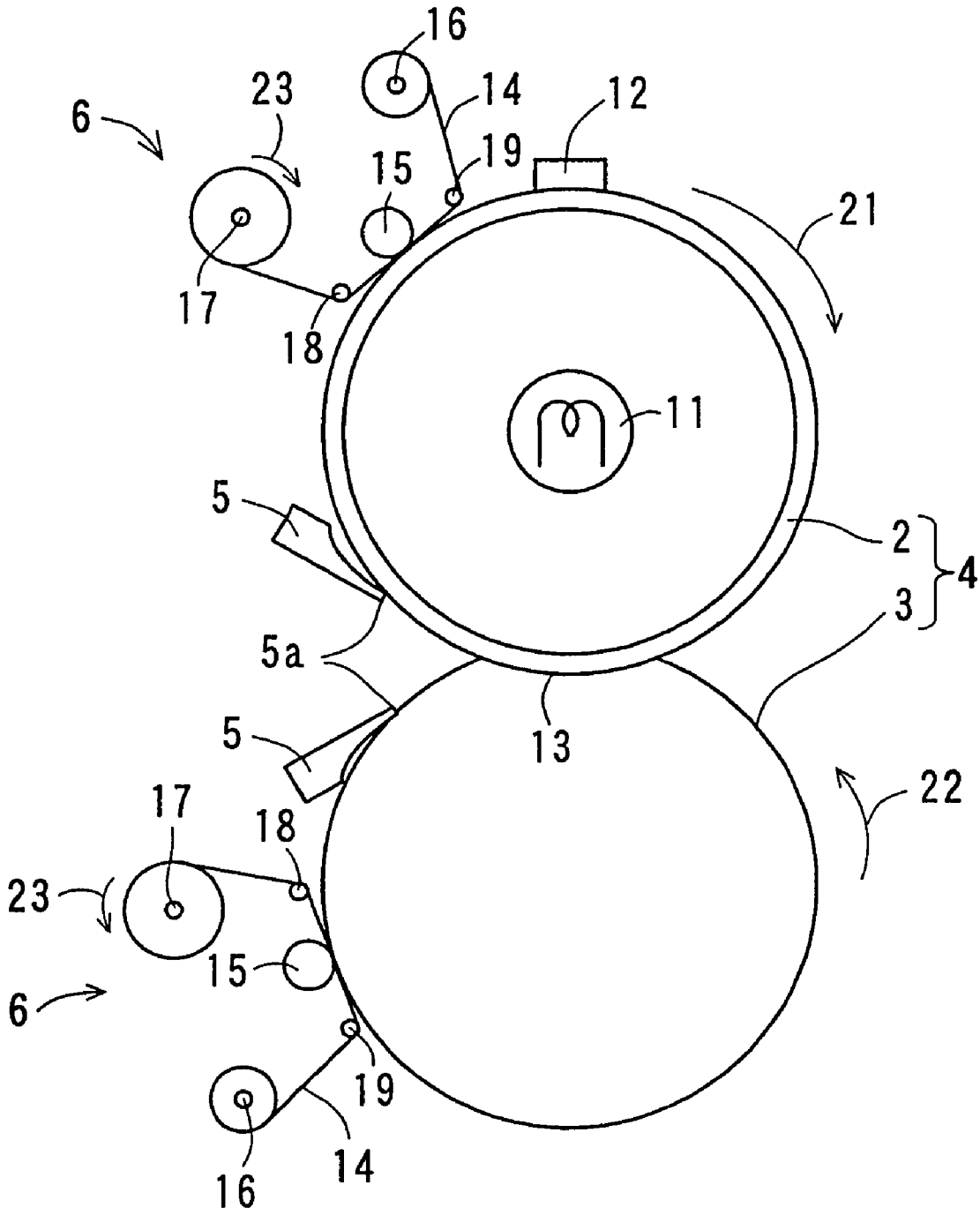
FIG. 1 is a schematic side view showing a constitution of a fixing device according to one embodiment of the invention.

Now referring to the drawings, preferred embodiments of the invention are described below.

Figure 2:
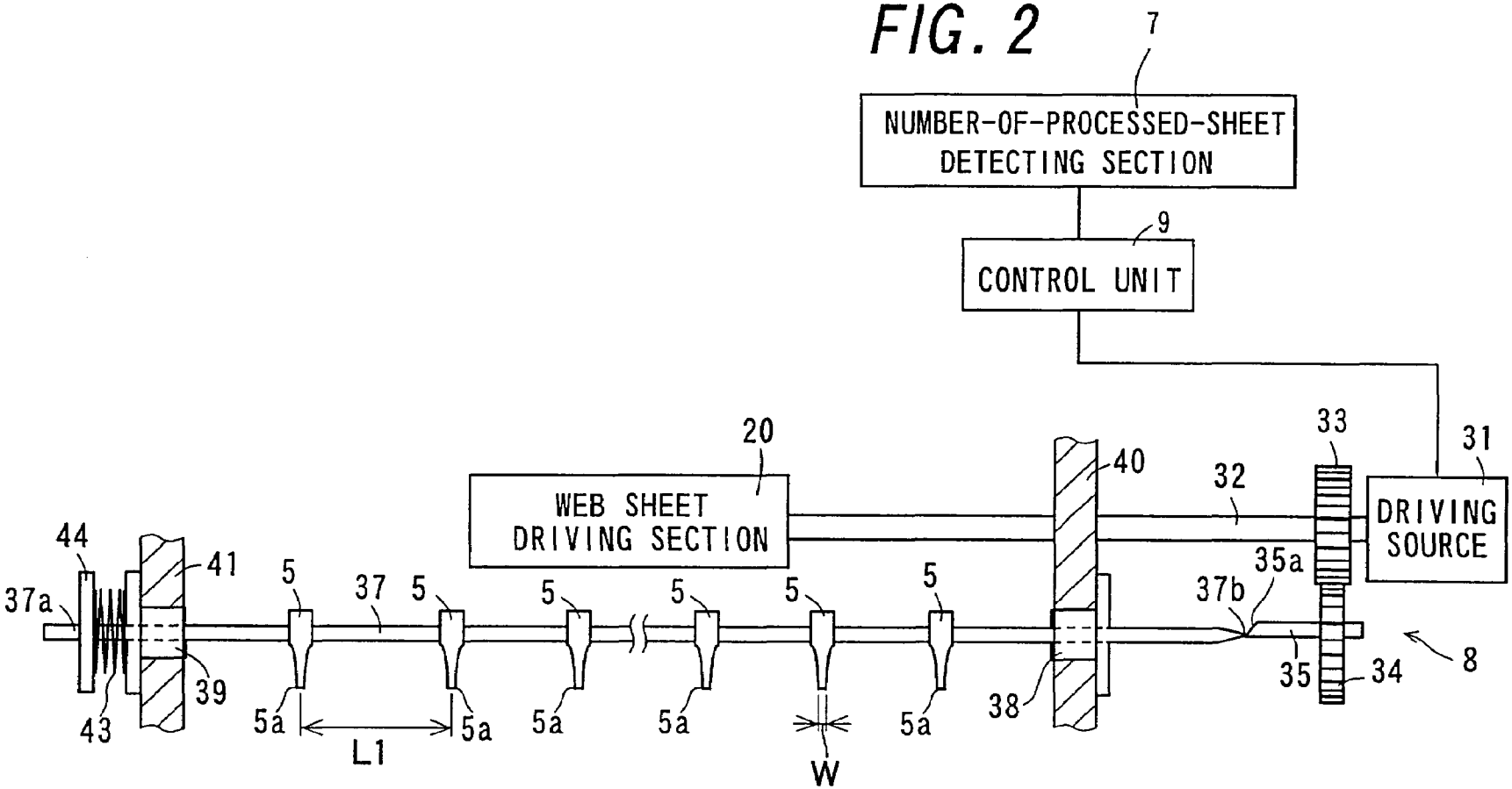
FIG. 2 is a systematic diagram showing a constitution in the vicinity of a peeling claw provided close to a heating roller of the fixing device of FIG. 1.

FIG. 1 is a schematic side view showing a constitution of a fixing device 1 according to one embodiment of the invention. FIG. 2 is a systematic diagram showing a constitution in the vicinity of a peeling claw 5 provided close to a heating roller 2 of the fixing device 1 of FIG. 1.

The fixing device 1 comprises fixing rollers 4, a plurality of the peeling claws 5, a fixing roller cleaning section 6, a number-of-processed-sheet detecting portion 7, a peeling claw driving section 8, and a control unit 9. The fixing rollers 4 have a heating roller 2 and a pressure roller 3. The plurality of peeling claws 5 are provided in order to peel off a recording medium, for example, recording paper, from the fixing roller 4. The fixing roller cleaning section 6 conducts a cleaning of the fixing roller 4 by removing developer adhered to the fixing roller 4. The number-of-processed-sheet detecting portion 7 detects the number of processed sheets of recording sheets treated with a fixing process upon passing through the fixing roller 4. The peeling claw driving section 8 moves a plurality of the peeling claws 5 in parallel with the axial direction of the fixing roller 4. The control unit 9 controls the peeling claw driving section 8 to operate so that a relative position between the peeling claw 5 and the fixing roller 4 changes according to a detected output of the number-of-processed-sheet detecting portion 7.

The fixing device 1 is equipped with various parts, similarly to those provided in a heretofore known fixing device, including: a heater control power source for supplying electric power to a heater 11 provided in the heating roller 2 which heater 11 serves as a heat source; a temperature sensor 12 for detecting a temperature of the heating roller 2; a press portion (not shown) where the pressure roller 3 is pressed against the heating roller 2; and a driving section (not shown) for driving the heating roller 2 and pressure roller 3 to rotate.

The fixing device 1 is mounted in an electrophotographic image forming apparatus, for example, and used for fusing and thus fixing non-fixed developer onto recording paper by making the recording paper on which an image formed of the non-fixed developer is formed, pass through a nip section 13 formed between the heating roller 2 and the pressure roller 3.

The fixing roller cleaning section 6 is provided in order to conduct a cleaning of the fixing roller 4 by removing the toner adhered to the fixing roller 4 as described above. In the embodiment, the fixing roller cleaning section 6 is provided on each of the heating roller 2 and the pressure roller 3. The fixing roller cleaning section 6 comprises a belt-shaped cleaning member (sometimes referred to as a web sheet) 14, a press-contact roller 15, a feed-out roller 16, a wind-up roller 17, a first guide roller 18, and a second guide roller 19. The belt-shaped cleaning member 14 is provided so as to contact each of the heating roller 2 and the pressure roller 3, and cleans a surface of the fixing roller 4. The cleaning member 14 has been previously wound up in a coil shape or a roll shape. The press-contact roller 15 is provided so as to press the cleaning member 14 against the fixing roller 4 with which the cleaning member 14 comes into contact. The feed-out roller 16 feeds the belt-shaped cleaning member 14. The wind-up roller 17 takes up the cleaning member 14 which has been fed from the feed-out roller 16 and then cleaned the surface of the fixing roller 4. The first guide roller 18 is provided between the press-contact roller 15 and the wind-up roller 17 so as to contact the cleaning member 14. The second guide roller 19 is provided between the feed-out roller 16 and the press-contact roller 15 so as to contact the cleaning member 14.

Note that the wind-up roller 17 is provided with a rotation driving section for taking up the cleaning member 14 and moreover, it is preferable that the feed-out roller 16 is also provided with a rotation driving section in order to make the cleaning member 14 usable in movements in both of forward and reverse directions as well as to exert a braking action on a feeding side at the times of winding and feeding. Since the wind-up roller 17 and the feed-out roller 16 drive the cleaning member (web sheet) 14 at the times of winding and feeding, these wind-up roller 17 and the feed-out roller 16 are collectively referred to as a web sheet driving section 20.

The fixing roller cleaning section 6 presses the cleaning member 14 against the heating roller 2 rotating in an arrow sign 21 direction and the pressure roller 3 rotating in an arrow sign 22 direction in a state where the wind-up roller 17 and feed-out roller 16 and the press-contact roller 15 are not made to rotate but stand still, so that the fixing roller 4 and the cleaning member 14 are made to be slidingly scrubbed with each other. By so doing, the toner attached in a fused state to a peripheral face of the fixing roller 4 is removed, and then the removed toner is, still in a substantially fused state, accumulated in a gap which is formed between the cleaning member 14 located between the pressure roller 15 and the first guide roller 18, and the surface of the fixing roller 4.

When the toner being accumulated in the gap reaches a certain amount, the fixing roller cleaning section 6 makes the wind-up roller 17 move in an arrow sign 23 direction to conduct the wind-up operation so that the cleaning member 14 is taken up by a predetermined length and detached from the surface of the fixing roller 4 in a state where the toner is adhered to the cleaning member 14.

The web sheet driving section 20 composed of the wind-up roller 17 and the feed-out roller 16 is intermittently driven, and in the embodiment, this driving is carried out when the number of processed sheets, that is, the number of fix-processed sheets detected by the number-of-processed-sheet detecting portion 7 reaches the predetermined number of processed sheets. This intermittent driving operation is carried out together with an operation of the peeling claw driving section 8. Accordingly, the operation in detail will be described hereinafter.

Next, the peeling claw 5 and the peeling claw driving section 8 will be described. The peeling claw driving section 8 comprises: a driving source 31 including a motor, for example; a first gear 33 mounted on a output shaft 32 of the driving source 31; a second gear 34 engaged with the first gear 33; and a peeling claw driving shaft 35 which has the second gear 34 mounted thereon and serves as a driving shaft constituting a rotary shaft portion of the second gear 34. The output shaft 32 of the driving source 31 in the peeling claw driving section 8 is coupled on the web sheet driving section 20 in the fixing roller cleaning section 6 via a train of gears (not shown). Accordingly, the driving source 31 is shared by the web sheet driving section 20 in the fixing roller cleaning section 6, and the peeling claw driving section 8.

Figure 3A:
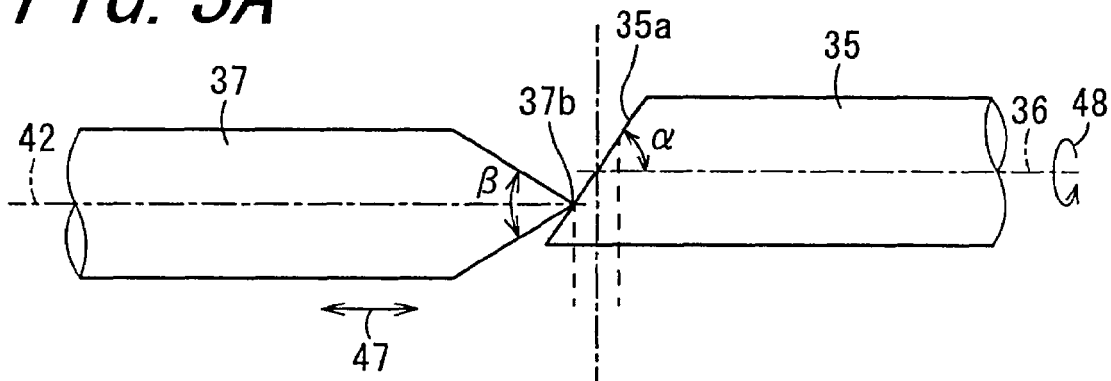
FIGS. 3A to 3C are enlarged views of the vicinity of an inclined end face of a peeling claw driving shaft.
Figure 3B:
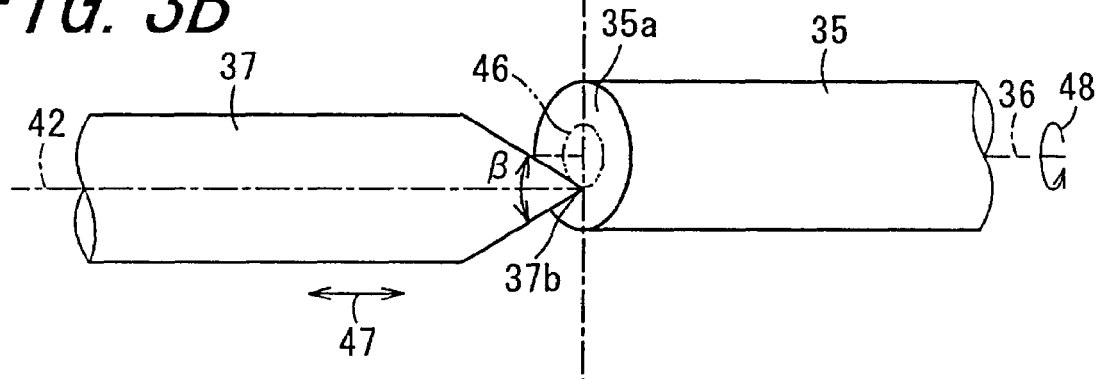
Figure 3C:
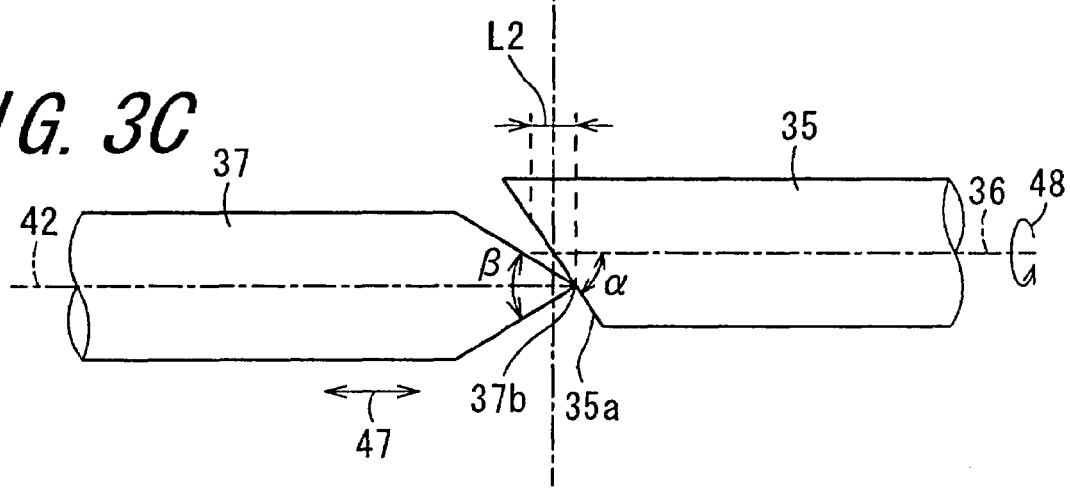

FIGS. 3A to 3C are enlarged views of the vicinity of an inclined end face 35*a* of the peeling claw driving shaft 35. The peeling claw driving shaft 35 is a member of cylindrical bar shape and characterized in that the inclined end face 35*a* facing the peeling claw 5 is cut so as to have a tilt angle α to a driving axial line 36. Accordingly, the end face 35*a* of the peeling claw driving shaft 35 will be hereinafter referred to as the inclined end face 35. One shaft 37 on which a plurality of the peeling claws 5 are mounted on, is formed separately from the peeling claw driving shaft 35 and provided so as to contact the inclined end face 35*a* of the peeling claw driving shaft 35. This will be hereinafter described in detail.

Returning to FIG. 2, a plurality of the claws 5 are mounted on one shaft 37, regularly spacing out a predetermined distance L1. In FIG. 2, only components provided on the heating roller 2-side are shown, and since a constitution of components provided on the pressure roller 3-side is the same as that on the heating roller 2-side, a drawing of the components on the pressure roller 3-side and descriptions thereof will be omitted.

One shaft 37 (hereinafter referred to simply as a shaft 37) is supported on first and second side frames 40 and 41 which are opposed to each other in the fixing device 1, by a first supporting member 38 and a second supporting member 39 so as to be freely slidable in a direction of an axial line 42 (hereinafter referred to as a shaft axial line 42) of the shaft 37. Note that the first supporting member 38 and the first side frame 40 respectively represent a supporting member and a side frame which are located close to the driving source 31. The second supporting member 39 and the second side frame 41 respectively represent a supporting member and a side frame which are located away from the driving source 31, and are respectively opposed to the first supporting member 38 and the first side frame 40.

The shaft 37 is disposed so as to be parallel to a rotary shaft line of the heating roller 2 and so that one end portion 5*a* of the peeling claw 5 mounted on the shaft 37 slightly contacts the surface of the heating roller 2. The shaft 37 penetrates the second supporting member 39, that is, the second side frame 41, and furthermore, penetrates a coil spring which is an elastic member provided in contact with an outer side of the second side frame 41. An end portion 37*a* of the shaft 37 around which end portion 37*a* the shaft 37 is supported by the second supporting member 39, is fixed on a retaining plate member 44 which is formed into a disc shape having a larger diameter than a diameter of a wound coil spring member 43.

The coil spring member 43 is, in a state of being slightly extended from a natural state and thus transformed, disposed between the retaining plate member 44 and the second supporting member 39, respectively to which both end portions of wound coil are attached. Accordingly, the coil spring member 44 can bias an end portion 37*b* of the slidable shaft 37 closer to the driving source 31 against the inclined end face 35*a* of the peeling claw driving shaft 35 in the peeling claw driving section 8 by an elastic force encouraging the coil sprint member 43 to be transformed by contraction thereof.

With reference to FIGS. 3A to 3C, a contact state between the peeling claw driving shaft 35 and the shaft 37 will be hereinbelow described. The coil spring member 43 biases the shaft 37 so that an end portion 37*b* closer to the driving source 31 comes into contact with the inclined end face 35*a* of the peeling claw driving shaft 35. The shaft 37 is manufactured so that the vicinity of the end portion 37*b* is formed into a cone shape. A tapered angle β on a section of this cone shape which section includes the shaft axial line 42, is formed so that a half of the angle β, that is, β/2 is smaller than the tilt angle α which forms the inclined end face 35*a* of the peeling claw driving shaft 35. This aims to enable the peeling claw driving shaft 35 to rotate without being inhibited by the end portion 37*b* of the shaft 37.

The shaft 37 is disposed so as to contact the peeling claw driving shaft 35 at a position where the shaft axial line 42 is decentered from the driving shaft line 36 of the peeling claw driving shaft 35. Accordingly, a rotational driving force of the driving source 31 is imparted to the peeling claw driving shaft 35 via the first gear 33 and the second gear 34 and when the peeling claw driving shaft 35 rotates in an arrow sign 48 direction around the driving shaft line 36, the end portion 37*b* of the shaft 37 which is decentered from the driving shaft line 36 and contacts the inclined end face 35*a* of the peeling claw driving shaft 35, contacts the inclined end face 35*a* at different positions according to an orientation of the inclined end face 35*a*. In other words, the end portion 37*b* of the shaft 37 will be made to move relatively along a virtual circle drawn by setting a radius thereof to an eccentric distance between the driving shaft line 36 and the shaft axial line 42, and positioned on the inclined end face 35*a* at different relative positions with respect to the peeling claw driving shaft 35.

The shaft 37 is provided so as to be biased against the peeling claw driving shaft 35 by the coil spring member 43, and freely advances and retracts in a direction of the shaft axial line 42, with the result that rotation in the arrow sign 48 direction of the peeling claw driving shaft 35 enables the shaft 37 to reciprocate in an arrow sing 47 direction indicating a direction which is the same as the direction of the shaft axial line 42 and moreover, parallel to the axial direction of the heating roller 2, while the end portion 37*b* of the shaft 37 moves relatively along the virtual circle 46 on the inclined end face 35*a*.

By so doing, a plurality of the peeling claws 5 mounted on the shaft 37 can move in a direction parallel to the shaft line of the heating roller 2 so that the peeling claws 5 are brought at different relative positions with respect to the heating roller 2. A transfer distance of the shaft 37 through this reciprocation, that is, a spaced distance L2 in the arrow sign 47 direction between a position of the shaft end portion 37*b*, as shown in FIG. 3A, in contact with the inclined end face 35*a* which position is the closest to the peeling claw 5, and a position of the shat end portion 37*b*, as shown in FIG. 3C, in contact with the inclined end face 35*a* which position is the closest to the driving source 31, is set to be equal to or longer than a width w of the end portion 5*a* of the peeling claw 5 in contact with the heating roller 2. Such setting can be realized by adjusting a shaft diameter of the peeling claw driving shaft 35, a tilt angle of the inclined end face 35*a* which is just formed, a size of the virtual circle 46 on the inclined end face 35*a* with which the end portion 37*b* of the shaft 37 is in contact, and a length of the width w of the end portion 5*a* of the peeling claw 5.

For the sake of convenience, the position shown in FIG. 3A of the shaft end portion 37*b* in contact with the inclined end face 35*a* which position is the closest to the peeling claw 5, is referred to as a stage position A, and the position shown in FIG. 3C of the shat end portion 37*b* in contact with the inclined end face 35*a* which position is the closest to the driving source 31, is referred to as a stage position C, and an intermediary position between the stage position A and the stage position C is referred to as a stage portion B. In the embodiment, when the detected output of the number-of-processed-sheet detecting portion 7 reaches the predetermined number of sheets, the control unit 9 makes the peeling claw driving section 8 operate and by so doing, the shaft 37 on which a plurality of the peeling claws 5 are mounted, reciprocates in the arrow sign 47 direction so that the relative position between the peeling claw 5 and the heating roller 2 changes in such a stepwise fashion as a sequential movement to the stage position A, the stage position B, the stage portion C, the stage position B, the stage position A, and so forth.

The control unit 9 is a process circuit having a central processing unit (CPU), for example, and realized by a microcomputer. The control unit 9 controls, as described above, the peeling claw driving section 8 to operate so that the relative position between the peeling claw 5 and the fixing roller 4 changes according to the detected output of the number-of-processed-sheet detecting portion 7.

Figure 4:
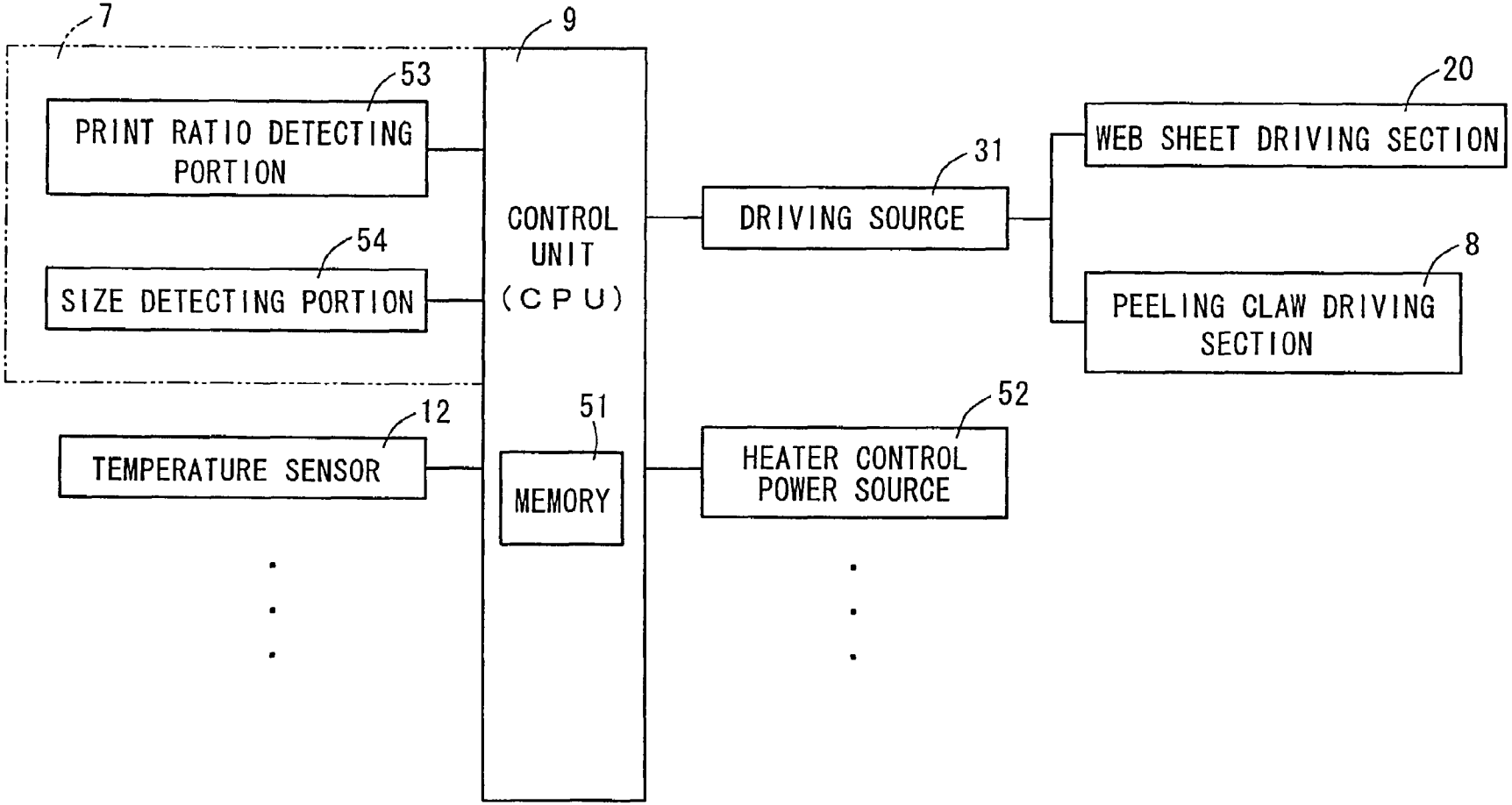
FIG. 4 is a block diagram showing an electrical constitution according to a control of a control unit in the fixing device.

FIG. 4 is a block diagram showing an electrical constitution according to a control of the control unit 9 in the fixing device 1. The control unit 9 is provided with a memory 51 serving as a storing portion. To an input side of the control unit 9 is connected a temperature sensor 12 for detecting temperatures of the number-of-processed-sheet detecting portion 7 and the heating roller 2, and to an output side of the control unit 9 is connected a heater control power source 52 for switching electric power supply on and off to the heater 11 of the driving source 31 and heating roller 2. On the driving source 31 on the output side is further coupled the wind-up roller 17 and the feed-out roller 16 which are referred to as the web sheet driving section 20 as described above, and the peeling claw driving section 8.

Note that the control unit 9 and the number-of-processed-sheet detecting portion 7 may be provided as devices which are exclusively used for the fixing device 1, but preferably provided as apparatuses which are used also for an image forming apparatus according to another embodiment of the invention as will be hereinafter described. When the control unit 9 and the number-of-processed-sheet detecting portion 7 are provided as apparatuses used also for the image forming apparatus, to the control unit 9 are connected many input systems and output systems other than all components shown in FIG. 4, but these systems are omitted in order to avoid intricacy of the drawing.

In the embodiment, the number-of-processed-sheet detecting portion 7 comprises a print ratio detecting portion 53 for detecting a print ratio of printing onto the recording paper, a size detecting portion 54 for detecting a size of recording paper which is subjected to printing, and a control unit 9 having a calculation function. The embodiment exemplifies a case where a control system including the number-of-processed-sheet detecting portion 7 and the control unit 9 is used also for the image forming apparatus.

In a case where the control system is used also for the image forming apparatus, image information is given from an external device including a personal computer, for example, to the control unit 9 in form of digital data. Since the print ratio of images is included in the image information, the control unit 9 which has received the image information can function also as the print ratio detecting portion 53 for the image information.

When the image information is given together with a print command from the personal computer to the control unit 9, information according to the print command includes the size of the recording paper on which an image is to be formed, and therefore the control unit 9 can likewise function also as the size detecting portion 54 for detecting the size of the recording paper. Moreover, when the image information once stored in the memory 51 of the control unit 9 is read out on the image forming apparatus to form an image, for example, when an operator inputs a print request from an operating portion of the image forming apparatus so that an image is formed, the inputted print request information includes the size of the recording paper, with the result that the control unit 9 which receives the print request information can function also as the size detecting portion 54 for detecting the size of the recording paper.

It is conceivable that a toner amount being accumulated on the peeling claw 5 for peeling off the recording paper from the fixing roller 4 is substantially proportional to a toner amount on the recording paper which toner is fixed at the fixing roller 4 and passes through the peeling claw 5. Accordingly, on the basis of the same size of the recording paper, a higher print ratio leads faster accumulation of the toner, and on the basis of the same print ratio, a larger size of the recording paper leads faster accumulation of total toner on a plurality of the peeling claws 5.

Accordingly, on the basis of the size of the recording paper and the print ratio for the recording paper, a coefficient for weighting is obtained, and the number of the to-be-processed recording paper having certain size and print ratio is converted to the standard number of sheets in a case of being printed on the recording paper of a standard size at a standard print ratio, with the result that the obtained value can be recognized as an index for estimating the accumulated amount of the toner on the peeling claw 5. This index value is accumulated at the control unit 9 every time the fixing operation is carried out on the recording paper, and when this accumulated value reaches the predetermined number of converted sheets, that is, the predetermined number of the processed sheets, the control unit 9 drives the peeling claw driving section 8 to make a plurality of the peeling claws 5 gradually move in the axial direction of the fixing roller 4. This makes it possible to diversify away the risk of contamination to the fixing roller 4 and the recording paper passing through the fixing roller 4 which contamination is caused by the toner accumulated on the peeling claw 5, and moreover to diversify away the risk of giving damage on the fixing roller 4.

FIG. 5 and FIG. 6 are views illustrating table data for converting the size and print ratio of the recording paper to the standard index values. With reference to FIG. 5 and FIG. 6, descriptions will be given to one example of techniques for converting the size of the recording paper which is subjected to printing and the ratio of printing carried out on the recording paper to the standard index values. In this illustration is standardized a case where a paper of A4 size prescribed in Japanese Industrial Standards (JIS) P0138 is widthwise conveyed and treated with the fixing process.

In FIG. 5 is shown a conversion ratio for converting the prints on papers of various sizes to a case of an A4 size widthwise conveyance serving as a standard index. In FIG. 6 is shown a conversion ratio for converting the value which has been converted to the case of the A4 size widthwise conveyance, to a case of a print ratio of 5% or less which is selected as a standard, further in the A4 size widthwise conveyance.

A calculation of the accumulated value in the control unit 9 will be illustrated hereinbelow. For example, when the recording paper passing through the fixing roller 4 just has a print ratio of 8 to 12% in a size A3, this is converted to the standard index value which is a print ratio of 5% or less in the A4 size widthwise conveyance. First, a paper of A3 size is converted to two sheets of the recording papers of the print ratio of 8 to 12% in the A4 widthwise conveyance by multiplying the conversion rate 2.00 based on the table data in FIG. 5. Next, the print ratio of 8 to 12% in the A4 widthwise conveyance is converted to four sheets of the recording papers by multiplying the conversion rate 2.00 for converting to the print ratio of 5% or less in the A4 widthwise conveyance based on the table data in FIG. 6. Thus, when one sheet of the recording paper of the print ratio of 8 to 12% in the A3 is treated with the fixing process, the number of the recording paper is converted to the four sheets of the recording papers of the print ratio of 5% or less in the A4 widthwise conveyance serving as the standard index value. The table data as shown in FIG. 5 and FIG. 6 can be previously created by determining the standard of the size of the recording paper and the print ratio, and the created table data is previously stored in the memory 51.

Every time one sheet of the recording paper is treated with the fixing process in the fixing device 1, the control unit 9 thus converts the number of the recording paper to the standard index value, and performs a calculation of accumulating the converted value so as to obtain the accumulated value. When this accumulated value becomes equal to or larger than the standard value stored in the predetermined memory 51, that is, the predetermined number of processed sheets, the control unit 9 outputs an operational command to operate the driving source 31 so that a plurality of the peeling claws 5 are made to move in the axial direction of the feed-out roller 4.

Note that the number-of-processed-sheet detecting portion 7 is not limited to that described above having such an exact constitution, but may be a number-of-processed-sheet counter for simply counting the number of recording papers passing through the fixing device, regardless of the size and print ratio of the recording paper, which counter may be composed of an optical detecting switch, for example. However, the toner amount accumulated on the peeling claw 5 largely relates to the size and print ratio of the recording paper passing by the peeling claw 5 and therefore, the number-of-processed-sheet detecting portion 7 is more preferably composed, as described above, of the print ratio detecting portion 53, the size detecting portion 54, and the control unit 9.

Note that, in the fixing device 1 in the embodiment, the driving source 31 is used as a driving source for both of the peeling claw driving section 8 and the web sheet driving section 20 and therefore, every time the number of the recording papers passing through the fixing roller 4 reaches the predetermined number of processed sheets which number is counted after converted to the standard index value, an operation for moving the peeling claw 5 and the wind-up operation of the cleaning member (web sheet) 14 are simultaneously carried out.

It is preferable to set a taken-up length of the cleaning member 14 per one wind-up occasion to equal to or longer than a circumferential length of the nip section 13 formed between the heating roller 2 and the pressure roller 3. By thus setting the taken-up length, it is possible to reliably feed an unused and clean portion of the cleaning member 14 to the nip section 13. Consequently, a cleaning performance of the cleaning member 14 can be reliably recovered.

According to a main object of the invention that is to prevent the fixing roller from being contaminated or damaged due to the toner which is adhered and accumulated to the peeling claw 5 from the recording paper passing there through, the transfer distance of the peeling claw 5 just has to satisfy a condition that a maximum transfer distance in the reciprocating movement is not shorter than the width w of the end portion 5*a* of the peeling claw 5 in contact with the fixing roller 4, and as long as the condition is satisfied, the transfer distance of the peeling claw 5 is not particularly limited. Through adjustment of rotation amount (to be more exact, angular displacement) of the peeling claw driving shaft 35, the transfer distance of the peeling claw 5 per one time is set by selecting one stage between stage positions which sequentially transits to the stage position A, the stage position B, the stage position C, the stage position B, the stage position A, and so forth as described above.

Figure 7:
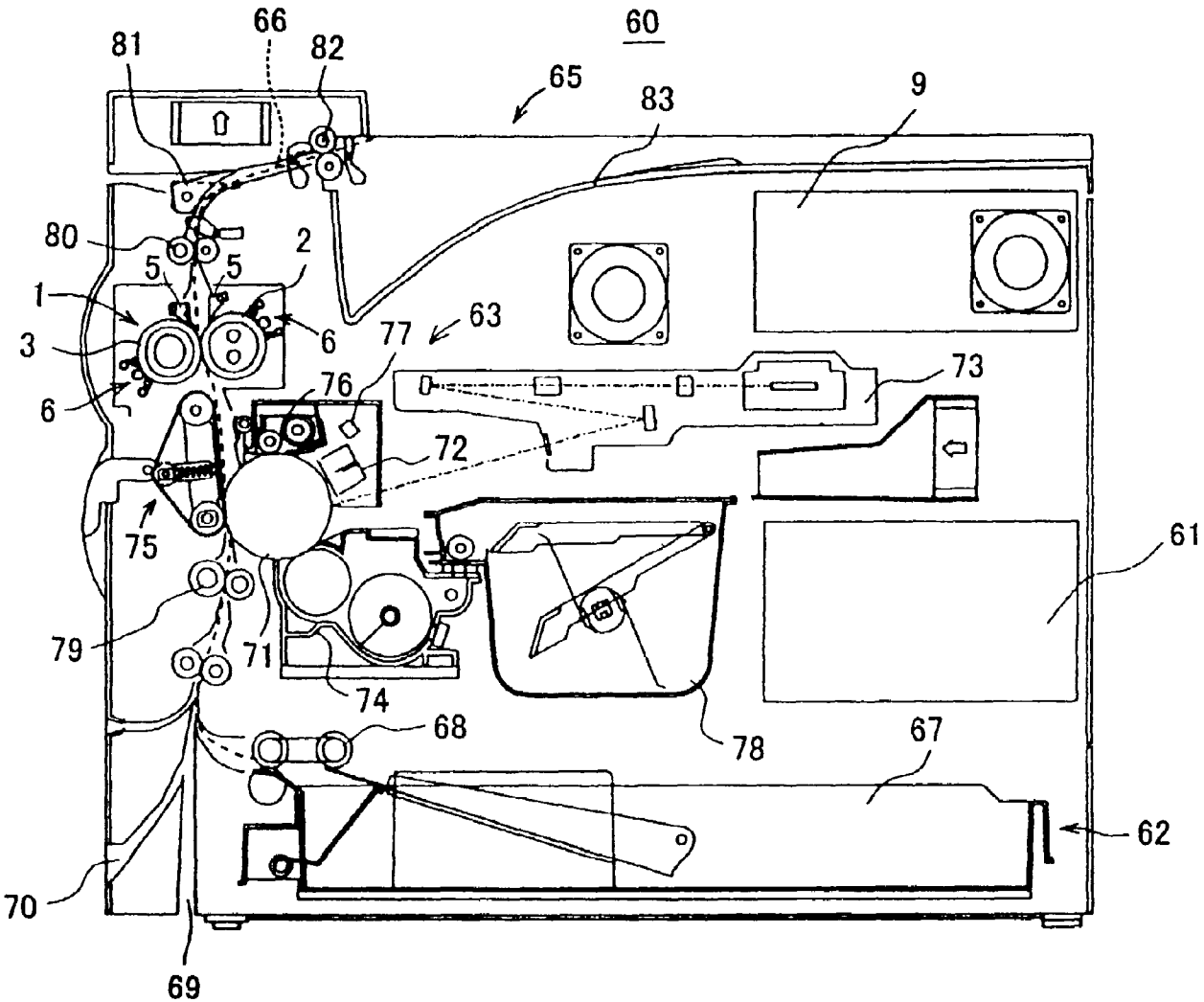
FIG. 7 is a schematic view showing a constitution of an image forming apparatus according to another embodiment of the invention.

FIG. 7 is a schematic view showing a constitution of an image forming apparatus 60 according to another embodiment of the invention. The image forming apparatus 60 is provided with the above-described fixing device 1. The image forming apparatus 60 largely comprises: a power device 61 for supplying electric power to various portions of the image forming apparatus 60; a sheet supply portion 62 for supplying recording paper serving as a recording medium on which an image is formed and recorded; an image forming unit 63; the fixing device 1; the control unit 9 for receiving image information from an external equipment and controlling an entire operation of the image forming apparatus 60; a discharge portion 65; and a sheet conveying system 66 for controlling conveyance of recording paper from the sheet supply portion 62 to the discharge portion 65.

The sheet supply portion 62 is provided with a supply tray 67 for housing recording paper, and a pickup roller 68 for feeding the recording paper housed in the supply tray 67 sheet by sheet to the sheet conveying system 66. Note that under the sheet supply portion 62 and under a main body of the image forming apparatus, a sheet supplying device including a multistage sheet tray, a high-capacity sheet supplying device capable of housing sheets in large quantity, or the like may be disposed as a peripheral equipment. In a case where such a peripheral equipment is provided, the recording paper from the peripheral equipment is supplied from a sheet receiving portion 69 and an expansive sheet receiving portion 70 to the main body of the image forming apparatus.

The image forming unit 63 is disposed above the sheet supply portion 62. The image forming unit 63 comprises a photoreceptor 71, and a charging device 72, a light scanning unit 73, a developing unit 74, a transfer device 75, a photoreceptor cleaning unit 76, and an electricity removing lamp 77, which are disposed along an outer circumferential surface of the photoreceptor 71.

The charging device 72 uniformly charges a surface of the photoreceptor 71 which has not yet been exposed to light by the light scanning unit 73. The light scanning unit 73 scans the uniformly charged photoreceptor 71 with light in accordance with the image information so as to form an electrostatic latent image. The developing unit 74 supplies the developer inside a developer supply container 78 to the electrostatic latent image formed on the surface of the photoreceptor 71 so as to form a visualized developer image.

The transfer device 75 transfers the developer image onto the recording paper which is supplied in arranged timing so that a registration roller 79 provided upstream of the photoreceptor 71 in the sheet conveying system 66 registers the recording paper at a developer image forming position on the photoreceptor 71.

The photoreceptor cleaning unit 76 removes a residual developer which has not been transferred on the recording paper and remains on the photoreceptor 71. The electricity removing lamp 77 removes charges on the surface of the photoreceptor 71, thereby preparing for next uniform charging of the charging device 72.

The fixing device 1 is provided downstream of the transfer device 75 in the sheet conveying system 66 so that the developer image transferred on the recording paper is fixed so as to form a solid recording image.

A conveyance roller 80 and a switching gate 81 are disposed further downstream of the fixing device 1 in the sheet conveying system 66. The conveyance roller 80 conveys the recording paper which has been peeled off from the fixing roller 4 by the peeling claw 5 and passed through the fixing device 1, to further downstream in the sheet conveying system 66. The switching gate 81 optionally opens a conveyance path which is suitable for the recording paper to be conveyed by the conveyance roller 80. The discharge portion 65 comprises a discharge roller 82 provided further downstream of the switching gate 81 in the sheet conveying system 66, and a discharge tray 83 for placing the recording paper discharged outward the main body of the image forming apparatus by the discharge roller 82.

The control unit 9 used also for the fixing device 1 has accessories such as an interface for receiving image information from an external equipment. The control unit 9 controls an entire operation of the image forming apparatus 60, which operation includes the operation of the fixing device 1. The memory 51 of the control unit 9 previously stores a program and an operational control condition for controlling the entire operation of the image forming apparatus 60.

An image forming operation in the image forming apparatus 60 will be described hereinafter. For example, image information produced by external equipments such as a personal computer is given to the control unit 9 via the interface and then, the image information is stored in the memory 51 of the control unit 9. The control portion 9 reads out the image information from the memory 51 and performs image processing such as conversion process. And then, the control unit 9 feeds to the light scanning unit 73 the image information on which the image processing has been performed. The light scanning unit 73 irradiates the surface of the photoreceptor 71, which has been charged by the charging device 72 so as to have a uniform electric potential, with light in accordance with the image information to form an electrostatic latent image.

The electrostatic latent image formed on the surface of the photoreceptor 71 is developed by the developing unit 74 so as to be a developer image. The transfer device 75 transfers the developer image formed on the photoreceptor 71 onto the recording paper which has been supplied from the sheet supply portion 62 and fed in arranged timing by the registration roller 79. The recording paper, on which the developer image has been transferred, is treated with the fixing process by the fixing device 1 and then discharged to the discharge tray 83 by the discharge roller 82.

On the other hand, the photoreceptor 71 from which the developer image is detached by the transfer device 75, is cleaned by the cleaning unit 76 so that the residual developer remaining on the surface of the photoreceptor 71 is removed, and the electricity on the surface of the photoreceptor 71 is removed by the electricity removing lamp 71. The image forming apparatus 60 can repeat the aforementioned image forming operation.

The fixing device 1 mounted on the image forming apparatus 60 operates so that the toner on the recording paper is made to be fused and softened so as to be fixed on the recording paper and then the recording paper is made to be peeled off from the fixing roller 4 by the peeling claw 5 and fed out to the sheet conveying system 66. However, the toner is adhered to the fixing roller 4 by repeating the fixing operation on a plurality of the recording papers and moreover, the toner is adhered to the peeling claw 5.

Although the toner adhered to the fixing roller 4 is cleaned away by the cleaning member 14 of the fixing roller cleaning portion 6, a certain amount of the toner removed from the fixing roller 4 is accumulated on the cleaning member 14 and then, the web sheet driving section 20 is driven to take up the cleaning member 14 by a certain length so that a clean portion of the cleaning member 14 is made to newly come into contact with the fixing roller 4, whereby cleaning capability of the cleaning member 14 is recovered to continue cleaning of the fixing roller 4.

In the meantime, the toner adhered to the peeling claw 5 is not cleaned away, but by means of making the peeling claw 5 move in the axial direction of the fixing roller 4 so that the relative position between the fixing roller 4 and the peeling claw 5 is made to change, the contamination and damage caused by the toner accumulating on the peeling claw 5 are prevented.

The wind-up operation of the cleaning member 14 through the web sheet driving section 20 and the transfer of the peeling claw 5 through the peeling claw driving section 8 are intermittently carried out in accordance with the operational command from the control unit 9, every time the number of processed sheets which number is detected by the number-of-sheet detecting portion 7 and converted to the above-mentioned standard index value, reaches the predetermined number of sheets (hereinafter may be referred to a standard value).

The wind-up operation of the cleaning member 14 and the transfer operation of the peeling claw 5 in the fixing device 1 mounted on the image forming apparatus 60 will be described hereinbelow. FIG. 8 is a flow chart for explaining the transfer operation of the peeling claw 5 and the wind-up operation of the cleaning member 14 through the control unit 9.

At a start of step s0, the image forming apparatus 60 is in a state where, for example, image information previously created by a personal computer or the like is given to the image forming apparatus 60, and stored in the memory 51 of the control unit 9 in the image forming apparatus, and then the print request is inputted to the image forming apparatus 60 with the result that image read out from the memory 51 can be printed and fixed.

At step s1, a main power of the image forming apparatus 60 is turned on by the operator. At step s2, the control unit 9 initializes the image forming apparatus 60. Here, the initialization of the image forming apparatus 60 indicates a set of preliminary operations for the image forming apparatus 60 to perform image formation. The preliminary operations include removal of residual potential of the photoreceptor 71, temperature rising of the fixing roller 4 up to a prescribed temperature, and the like. At step s3, a print request is inputted by the operator from an input portion provided in the image forming apparatus 60. This print request includes a designation of the to-be-printed image information among the image information stored inside the memory 51, a designation of the size of the recording paper for recording the image information, and the number of printing sheets.

At step s4, the control unit 9 reads out from the memory 51 a standard value (X) which has been previously stored in the memory 51 as a predetermined number of processed sheets obtained by converting to the standard index value, and an accumulated value (Y1) obtained by accumulating the values which are obtained by converting to the standard index values during a previous print operation. On the basis of this standard value (X), timing is determined for the control unit 9 to carry out the operations of moving the peeling claw 5 and taking up the cleaning member 14.

At step s5, in response to the designation of the to-be-printed image information and the designation of the size of the recording paper for recording the image information, the number-of-processed-sheet detecting portion 7 composed of the print ratio detecting portion 53, the size detecting portion 54, and the control unit 9, detects the print ratio from the designated image information, and detects the size of the recording paper and furthermore, on the basis of the detected print ratio and recording paper size, calculates the standard index value (Yr) which is converted based on the table data shown in FIGS. 5 and 6 to the case of A4 widthwise conveyance and the print request 5% or less regarding the to-be-printed image information.

At step s6, a print process is executed in the image forming unit 63 of the image forming apparatus 60, and a fixing process is executed in the fixing device 1. At step s7, the control unit 9 obtains the accumulated value (Y2) by adding the standard index value (Yr) to the accumulated value (Y1), that is (Y2)=(Y1)+(Yr).

At step s8, the control unit 9 compares the accumulated value (Y2) and the standard value (X). When the accumulated value (Y2) is equal to the standard value (X) or more, the operation proceeds to step s9. When the accumulated value (Y2) is less than the standard value (X), the operation proceeds to step s11.

At step s9, the accumulated value (Y2) is equal to or more than the standard value (X) which is determined as timing for executing the operations, and therefore the control unit 9 outputs the operational command to the driving source 31 so that the peeling claw driving section 8 and the web sheet driving section 20 are driven for a predetermined length of time to move the peeling claw 5 and take up the cleaning member 14. Here, the predetermined length of time indicates a length of time taken for the peeling claw driving section 8 to move the peeling claw 5 by one stage between the stage positions in the sequential reciprocating movement of the peeling claw 5 to the three stage positions A, B, and C. The predetermined length of time is set to a length of time taken for the web sheet driving section 20 to take up the cleaning member 14 by a length which is at least equal to a circumferential distance of the nip section 13 formed between the heating roller 2 and the pressure roller 3.

At step s10, the peeling claw 5 is made to move by one stage so as to be in a state where the peeling claw 5 can come into contact at a shifted position with the fixing roller 4 and moreover take up the cleaning member 14 to carry out the cleaning with a clean portion thereof, with the result that the control unit 9 initializes the accumulated value (Y2) of the number of processed sheets (in the embodiment, to zero sheet).

At step s11 is determined whether there is next print process or not. This determination is conducted by the control unit 9. Since the previous print request includes the information of the number of the printing sheets, the control unit 9 can determine whether there is next printing or not by counting the number of times of the print process. When there is no next print process, the operation proceeds to step s12 and when there is a next print process, the operation returns to step s6 and the subsequent steps are repeated. At step s12, the accumulated value (Y2) is replaced by the accumulated value (Y1) and stored in the memory 51, and then the operation proceeds to End of step s13.

At the End of step s13, the main power of the image forming apparatus 60 can be turned off so as to end the image forming operation. In this case, a next image forming operation resumes from step s1. Moreover, at the End of step s13, it is also possible to bring a standby state that the print process is not operated, but neither is the main power turned off. In this case, the next image forming operation resumes from the print request at step s3.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device mounted in an electrophotographic image forming apparatus, the fixing device comprising:

fixing rollers having a heating roller and a pressure roller;

a plurality of peeling claws for peeling off recording medium from the fixing roller;

a fixing roller cleaning section for cleaning the fixing roller by removing developer adhered to the fixing roller;

a number-of-processed-sheet detecting portion for detecting a number of processed recording mediums treated with a fixing process upon passing through the fixing roller;

a peeling claw driving section for moving a plurality of the peeling claws in parallel with an axial direction of the fixing roller; and a control unit for controlling the peeling claw driving section to operate so that a relative position between the peeling claw and the fixing roller changes according to a detected output of the number-of-processed-sheet detecting portion;

wherein the fixing roller cleaning section comprises:

a cleaning member that is belt-shaped, wound up and provided so as to contact either one of the fixing rollers, for cleaning a surface of the fixing roller; a press-contact roller for pressing the cleaning member against the fixing roller with which the cleaning member comes into contact; a feed-out roller for feeding the cleaning member; a wind-up roller for taking the cleaning member which has been fed from the feed-out roller and then cleaned the surface of the fixing roller; and a driving source for taking up the cleaning member, wherein the driving source provided in the fixing roller cleaning section is used also as a driving source for the peeling claw driving section.

2. The fixing device of claim 1, wherein a travel distance of the peeling claws moved in parallel with the axial direction of the fixing roller by the peeling claw driving section is equal to or longer than a width of peeling claw, which width indicates a dimension of the peeling claw in a direction parallel to the axial direction of the fixing roller.

3. The fixing device of claim 1, wherein the plurality of the peeling claws for peeling off the recording medium from either roller of the heating roller or the pressure roller are mounted on one shaft, and by driving the one shaft at the peeling claw driving section, the plurality of the peeling claws mounted on one shaft move in parallel with the axial direction of the fixing roller.

4. The fixing device of claim 3, wherein the one shaft is made to reciprocate in parallel with the axial direction of the fixing roller by the peeling claw driving section.

5. The fixing device of claim 3, wherein the shaft for holding the plurality of the peeling claws, and a driving shaft of the peeling claw driving section are separately formed, and an elastic member is provided so that the shaft for holding the plurality of the peeling claws is biased against the driving shaft of the peeling claw driving section, and the shaft for holding the plurality of the peeling claws moves in parallel with the axial direction of the fixing roller with a contact position with the driving shaft changing as the driving shaft rotates.

6. An image forming apparatus for forming a print image by use of electrophotographic system, comprising the fixing device of claim 1.

* * * * *